US010801683B2

(12) United States Patent
Chun

(10) Patent No.: US 10,801,683 B2
(45) Date of Patent: Oct. 13, 2020

(54) DISPLAY CAPABLE OF PHOTOVOLTAIC POWER GENERATION

(71) Applicant: Honggu Chun, Seoul (KR)

(72) Inventor: Honggu Chun, Seoul (KR)

( * ) Notice: Subject to any disclaimer, the term of this patent is extended or adjusted under 35 U.S.C. 154(b) by 297 days.

(21) Appl. No.: 15/745,252

(22) PCT Filed: Jul. 22, 2016

(86) PCT No.: PCT/KR2016/008006

§ 371 (c)(1),
(2) Date: Jan. 16, 2018

(87) PCT Pub. No.: WO2017/018731

PCT Pub. Date: Feb. 2, 2017

(65) Prior Publication Data

US 2019/0003668 A1 Jan. 3, 2019

(30) Foreign Application Priority Data

Jul. 24, 2015 (KR) ..... 10-2015-0105400

(51) Int. Cl.

| | |
|---|---|
| ***F21S 9/03*** | (2006.01) |
| ***H05B 47/10*** | (2020.01) |
| ***G09F 9/33*** | (2006.01) |
| ***H05B 33/08*** | (2020.01) |
| ***H05B 33/14*** | (2006.01) |

(Continued)

(52) U.S. Cl.

CPC ..... *F21S 9/03* (2013.01); *G09F 9/33* (2013.01); *G09G 3/3233* (2013.01); *H05B 33/08* (2013.01); *H05B 33/14* (2013.01); *H05B 47/10* (2020.01); *F21Y 2115/15* (2016.08); *G09G 2300/0819* (2013.01); *G09G 2300/0842* (2013.01); *G09G 2300/0861* (2013.01); *G09G 2330/023* (2013.01)

(58) Field of Classification Search

CPC ..... F21S 9/03; G09F 9/33; G09G 3/3233; G09G 2300/0819; G09G 2300/0842; G09G 2300/0861; G09G 2330/023; H05B 33/08; H05B 33/14; H05B 37/02; F21Y 2115/15

USPC ..... 362/183

See application file for complete search history.

(56) References Cited

U.S. PATENT DOCUMENTS

2014/0111095 A1* 4/2014 Hashimoto ..... H05B 33/0845 315/150

FOREIGN PATENT DOCUMENTS

| | | | |
|---|---|---|---|
| JP | 2005-161713 | A | 6/2005 |
| JP | 2008-270084 | A | 11/2008 |
| JP | 2012-182894 | A | 9/2012 |

(Continued)

OTHER PUBLICATIONS

International Search Report for PCT/KR2016/008006.

*Primary Examiner* — Cara E Rakowski
*Assistant Examiner* — Jessica M Apenteng
(74) *Attorney, Agent, or Firm* — The PL Law Group, PLLC

(57) ABSTRACT

A light emitting device capable of photovoltaic power generation selectively connects a light emitting device to either a power unit or a charge unit according to a control signal. Thereby, when the light emitting device is in a display mode, the light emitting device is connected to the power unit and outputs light, and when the light emitting device is in a charge mode, the light emitting device is connected to the charge unit and provides power outputted from the light emitting device to the charge unit.

19 Claims, 8 Drawing Sheets

(51) Int. Cl.
*G09G 3/3233* (2016.01)
*F21Y 115/15* (2016.01)

(56) References Cited

FOREIGN PATENT DOCUMENTS

KR 10-1999-0060293 A 7/1999
KR 10-2008-0087355 A 10/2008

* cited by examiner

DISPLAY CAPABLE OF PHOTOVOLTAIC POWER GENERATION

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2016/008006, filed Jul. 22, 2016, which claims priority to the benefit of Korean Patent Application No. 10-2015-0105400 filed in the Korean Intellectual Property Office on Jul. 24, 2015, the entire contents of which are incorporated herein by reference.

TECHNICAL FIELD

The embodiments of the present invention relate to a display capable of photovoltaic power generation and, more particularly, to the production of electric power by using Light Emitting Device (LED) element of the display as a solar cell in reverse.

BACKGROUND ART

One of the biggest technical problems in the use of portable devices is battery life. For example, if a smartphone is continuously used, a battery cannot last a day, and it is inconvenient to replace or charge the battery.

Particularly, wearable devices such as smart-watches are required to be worn on the body, making it more inconvenient to replace or charge a battery during use. This inconvenience of charging is the biggest obstacle to expanding the market for wearable devices.

In the case such as a conventional electronic watch that includes a simple function, it is possible to run for a long time with a single battery. However, current battery manufacturing technology has difficulty in realizing a multi-function portable device such as a smart-phone or a smart watch capable of running for a long time with a small size battery.

As in conventional mechanical watches, it is possible to apply a method of automatically winding a spring in a watch by using a movement of the watch, but power production efficiency and portability in such a mechanical method are significantly low. In addition, it is possible to consider a method of charging by rotating a crown as in a general mechanical watch, for example, using a motor used for vibration notification as a generator. However, this is insufficient to produce desired electric power and may shorten the lifetime of portable devices due to frequent breakdown of mechanical parts. Therefore, charging the portable devices electronically, rather than mechanically, will be beneficial in reducing the trouble of the devices and increasing the lifespan of the devices.

An example of electronic charging is a solar cell. Electronic devices using the solar cell have been commercialized for decades. Calculators and electronic watches with the solar cell are the most common examples. In the case of calculators, there are products designed not to have a battery at all because electric power is sufficient by the solar cell alone.

Conventional electronic watches and calculators have a small power consumption, thus electric power can be sufficiently supplied only by a small-size solar cell. However, current portable devices such as a smart phone and a smart watch have high power consumption, thus a pretty large-size solar cell is required. That is, a solar cell is not a desirable solution for charging such portable devices. The background art described above is disclosed in Korean Patent Publication No. 10-1999-0060293.

SUMMARY

Embodiments of the present disclosure are intended to provide a light emitting device (LED) circuit capable of photovoltaic power generation.

In accordance with an aspect of the present disclosure, provided is an LED circuit capable of photovoltaic power generation, including an LED capable of operating in either a display mode for emitting light when electric power is supplied or a charge mode for producing electric power when light is received. The LED may be connected to a power unit that supplies the electric power or a charge unit that is supplied with the electric power produced; and a control unit for controlling a connection between the LED and the power unit and a connection between the LED and the charge unit. The control unit includes a control signal receiving unit receiving a control signal and a switching unit operating based on the control signal. When the control signal receiving unit receives a first control signal for operating the LED in the display mode in which the LED emits light, the control unit may control the switching unit to connect the LED to the power unit to supply the power to the LED so that the LED emits light. When the control signal receiving unit receives a second control signal for operating the LED in the charge mode in which the LED produces electric power, the control unit may control the switching unit to connect the LED to the charge unit to supply the electric power produced by the LED to the charge unit.

The LED may be an Active-Matrix Organic Light-Emitting Diode (AMOLED).

An embodiment of the present disclosure provides a Light Emitting Device (LED) display capable of photovoltaic power generation, including: an array of a plurality of LEDs. Each of the LEDs may operate in either a display mode for emitting light when electric power is supplied or a charge mode for producing electric power when light is received, and each of the LEDs is configured to be connected to a power unit that supplies the electric power or a charge unit that is supplied with the electric power produced. The LED display may further include a control unit for controlling a connection between each of the plurality of LEDs and the power unit and a connection between each of the plurality of LEDs and the charge unit. The control unit may include a control signal receiving unit receiving a control signal and a switching unit operating based on the control signal. When the control signal receiving unit receives a first control signal for operating in the display mode in which one or more first LED among the plurality of LEDs emits light, the control unit may control the switching unit to connect the one or more first LED to the power unit to supply the power to the one or more first LED so that the one ore more first LED emits light. When the control signal receiving unit receives a second control signal for operating in the charge mode in which one or more second LED among the plurality of LEDs produces electric power, the control unit may control the switching unit to connect the one or more second LED to the charge unit to supply the electric power produced by the one or more second LED to the charge unit.

Each of the plurality of LEDs may be an Active-Matrix Organic Light-Emitting Diode (AMOLED).

At least one of the one or more second LED may produce electric power while at least one of the one or more first LED emits light.

The at least one of the one or more second LED may produce the electric power from at least one of i) light from outside the LED display and ii) a portion of light emitted from the at least one of the one or more first LED.

At least one of a transparent electrode or a transparent substrate may be laminated on a light emitting surface of the plurality of LEDs.

A first pulse of the first control signal may cause a first LED among the plurality of LEDs to emit light in the display mode. A second pulse of a third control signal may cause a third LED among the plurality of LEDs to emit light in the display mode. At least one of the first pulse and the second pulse may be shifted in time within one period of each control signal so that overlap in the time domain between the first pulse and the second pulse is minimized. A part of the light emitted from the first LED may be totally reflected from the transparent electrode or the transparent substrate, and is incident on the second LED.

When the plurality of LEDs of the array are configured to include a plurality of colors, electric power generated by at least two or more LEDs of the same color among two or more of the second LEDs may be combined and are provided to the charge unit independently of electric power generated by the LEDs of different colors.

Two or more second LEDs produce electric power and the control unit may be configured to connect at least two second LEDs among the two or more second LEDs in series to provide increased electric power to the charge unit.

When the power unit is turned off, the control unit may be configured to connect the array of the plurality of LEDs to the charge unit via the switching unit.

A method for operating a light emitting device (LED) display capable of photovoltaic power generation may include: receiving either a first control signal causing each of a plurality of LEDs included in the LED display to operate in a display mode to emit light or a second control signal causing each of the plurality of LEDs to operate in a charge mode to produce electric power. Each of the plurality of LEDs may operate either in the display mode or in the charge mode. The method may further include: connecting, when the first control signal to operate one or more first LED among the plurality of LEDs in the display mode for emitting light is received, the one or more first LED to a power unit to emit light; and supplying, when the second control signal to operate one or more second LED among the plurality of LEDs in the charge mode for producing electric power is received, electric power generated by the one or more second LED to a charge unit by connecting the one or more second LED to the charge unit.

Each of the plurality of LEDs may be an Active-Matrix Organic Light-Emitting Diode (AMOLED).

At least one of the one or more second LED may produce electric power while at least one of the one or more first LED emits light.

The at least one of the one or more second LED may produce the electric power from at least one of i) light from outside the LED display and ii) a portion of light emitted from the at least one of the one or more first LED.

At least one of a transparent electrode or a transparent substrate may be laminated on a light emitting surface of the plurality of LEDs.

A first pulse of the first control signal may cause a first LED among the plurality of LEDs to emit light in the display mode. A second pulse of a third control signal may cause a third LED among the plurality of LEDs to emit light in the display mode. At least one of the first pulse and the second pulse may be shifted in time within one period of each control signal so that overlap in the time domain between the first pulse and the second pulse is minimized. A part of the light emitted from the first LED may be totally reflected from the transparent electrode or the transparent substrate, and be incident on the second LED.

When the plurality of LEDs of an array of the LEDs are configured to include a plurality of colors, electric power generated by at least two or more LEDs of the same color among two or more of the second LEDs may be combined and are provided to the charge unit independently of electric power generated by the LEDs of different colors.

Two or more second LEDs may produce electric power; and the method may further include: connecting at least two second LEDs among the two or more second LEDs in series to provide increased electric power to the charge unit.

The charge mode of the LED display according to the present disclosure may dramatically increase the operation time of portable devices including a smart-watch, a smartphone, a tablet, and a notebook. In addition, an energy saving effect of devices such as a PC monitor and a TV display can be achieved by the charge mode of the LED display according to the present disclosure.

DETAILED DESCRIPTION

Figure 1:
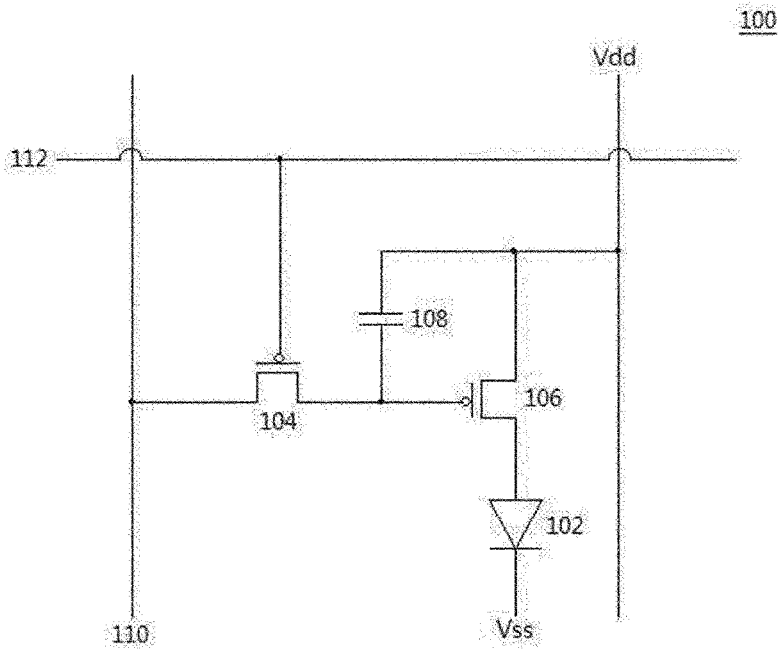
FIG. 1 shows a circuit diagram for a conventional LED.

Referring to FIG. 1, a general driving principle of a conventional LED circuit will be described.

FIG. 1 shows a circuit in which transistors 104 and 106 and a capacitor 108 drive an LED 102. A signal applied to a gate line 112 of the transistor 104 may determine an on/off state of the transistor 104, and a voltage applied to the capacitor 108 may be determined by a signal applied to a source line 110. An on/off state of the transistor 106 is determined by the voltage applied to the capacitor 108 so that an on/off state of the LED 102 is determined.

When it is desired to divide the brightness of each LED into 256 steps (8 bits) and to drive a screen at a frame rate of 60 frames per second, a voltage to flow a corresponding current may be charged to the capacitor 108 through the source line 110 of the transistor 104 and the gate line 112 of the transistor 104 may be accessed to 60 Hz.

Alternatively, in the case of the pulse width modulation (PWM) method, a voltage capable of providing a maximum current value may be charged to the capacitor 108 via the source line 110 of the transistor 104, and the gate line 112 of the transistor 104 may be accessed to 15.36 KHz (=256×60).

Figure 2A:
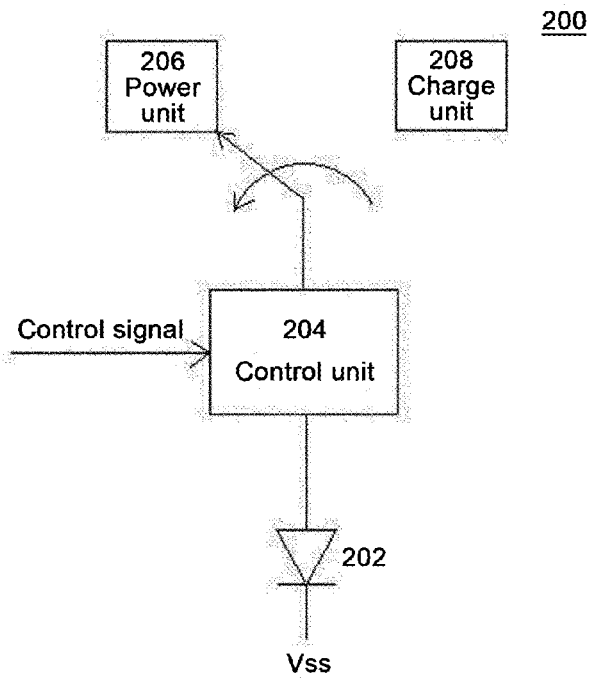
FIG. 2A shows a block diagram of an LED circuit in a display mode according to an embodiment of the present disclosure.

FIG. 2A shows a block diagram of an LED circuit in a display mode according to an embodiment of the present disclosure. In order to place an LED 202 in a display mode, a control unit 204 is configured to connect the LED 202 to a power unit 206 based on a control signal (e.g., a first signal) so that the LED 202 emits light. In the display mode, the brightness of the LED 202 may be adjusted 1) by controlling a current flowing through the LED 202 or 2) by allowing a constant current to flow through the LED 202 and adjusting the ON time of the LED 202 by pulse width modulation (PWM) according to a control signal.

Figure 2B:
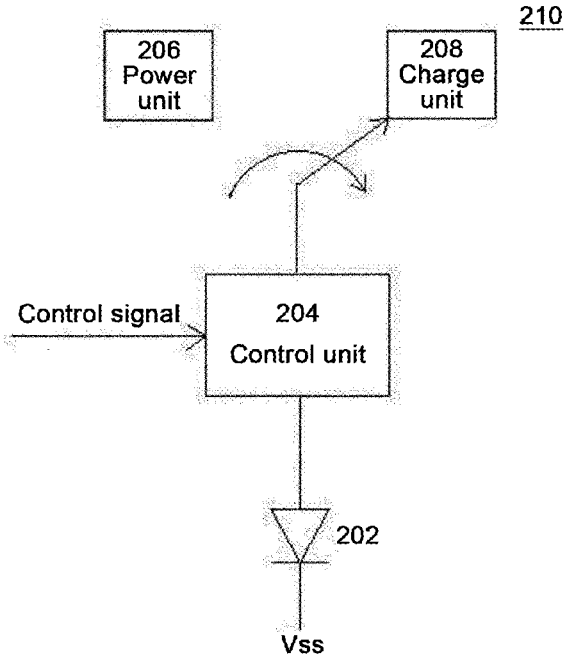
FIG. 2B shows a block diagram of an LED circuit in a charge mode according to an embodiment of the present disclosure.

FIG. 2B shows a block diagram of an LED circuit in a charge mode according to an embodiment of the present disclosure. In order to place the LED 202 in a charge mode, the control unit 204 is configured to connect the LED 202 to a charge unit 208 based on a control signal (e.g., a second signal), thereby providing electric power generated from light inputted to the LED 202 to the charge unit 208. In the charge mode, the electric power generated by the LED 202 may be configured to be supplied directly to the power unit 206 via the charge unit 208, or may be configured to charge a separate battery via the battery charge circuit of the charge unit 208. In the charge mode, the control unit 204, according to a control signal, may be set to be always on in order to send electric power generated by the LED 202 to the charge unit 208 without loss. In the charge mode, a control signal may be set to make a screen in the display mode white.

Although the LED is described as a light emitting device in the above, it is not limited thereto, and the light emitting device may include an Organic Light-Emitting Diode (OLED), an Active-Matrix Organic Light-Emitting Diode (AMOLED) or any corresponding light emitting device.

Figure 3A:
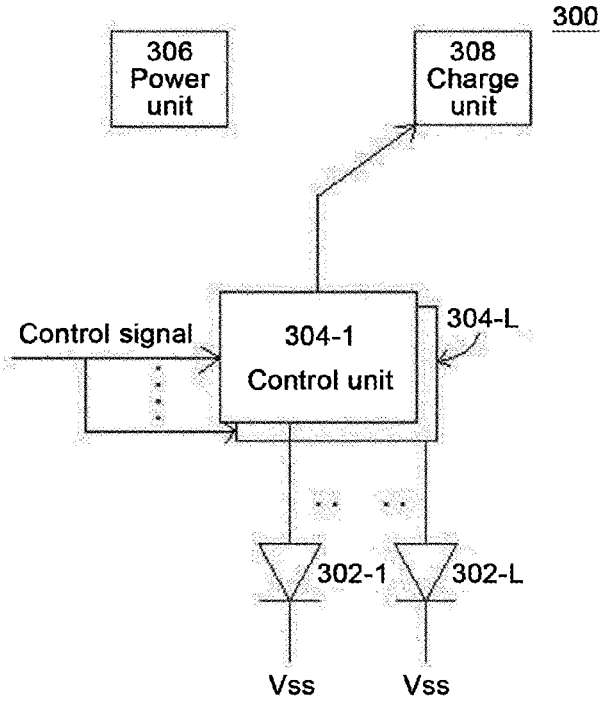
FIGS. 3A to 3C show a block diagram of an LED circuit in a charge mode according to an embodiment of the present disclosure.
Figure 3B:
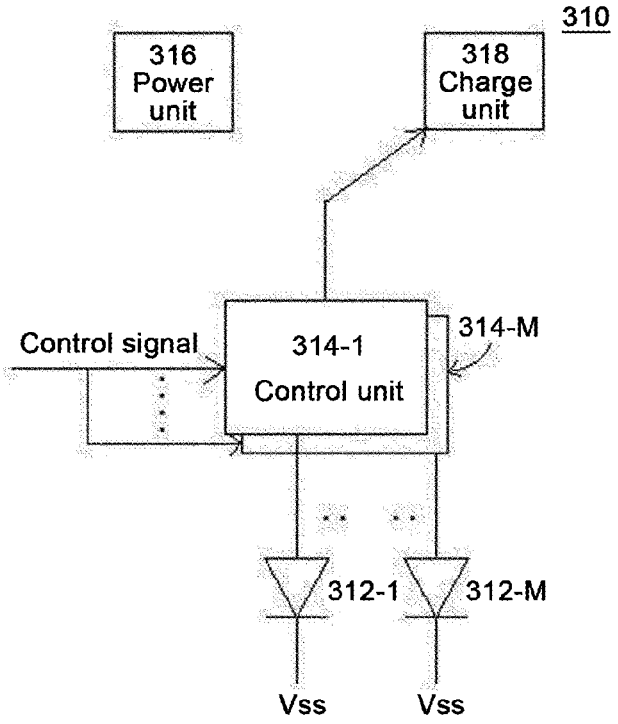
Figure 3C:
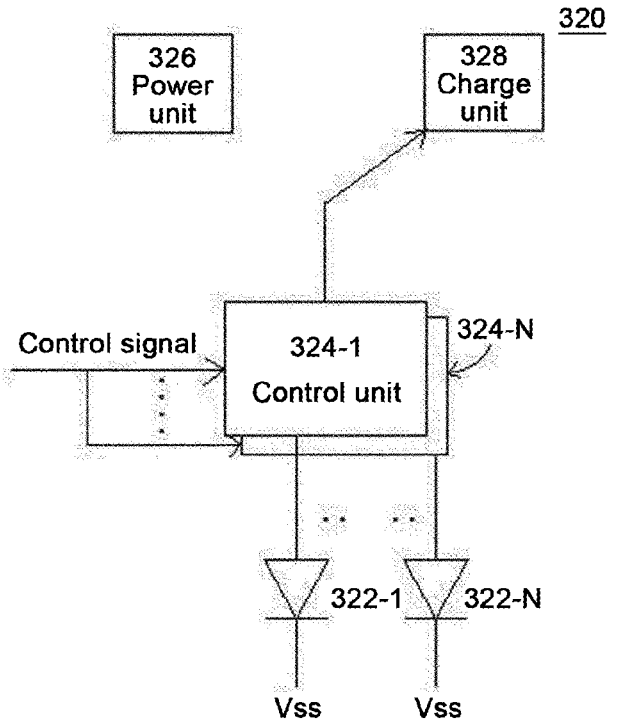

FIGS. 3A to 3C show a block diagram of an LED circuit in a charge mode according to an embodiment of the present disclosure. To be specific, FIGS. 3A to 3C show configurations for connecting electric power generated by a LED to a charge circuit depending on color of LEDs when a LED display includes LEDs of three colors.

An LED emitting light with a short wavelength (for example, blue light) uses a material having a large band gap, and an LED emitting light having a long wavelength (for example, red light) uses a material having a small band gap. A high voltage is required to drive an LED with a large band gap, and an LED with a low band gap can be driven with a low voltage. The size of a band gap of each color LED is in the following order: a blue color LED>a green color LED>a red color LED. The size of the forward voltage required to drive each color LED is in the following order: a blue color LED>a green color LED>a red color LED.

Likewise, when an LED display with two or more color LEDs receives solar light and produces electric power, the size of a produced voltage according to the color of LED is in the following order: a blue color LED>a green color LED>a red color LED. Therefore, if power output portions of LEDs are connected to each other regardless of color of a LED, electric power generated by a blue color LED may be used to turn on a green color LED or a red color LED, and electric power generated by a green color LED may be used to turn on a red color LED. Therefore, the efficiency of transferring energy to a charge unit may be reduced. In order to increase the efficiency of transferring energy to a charge unit, power output portions of LEDs having the same color may be connected and power output portions of LEDs having different colors may be electrically disconnected, electric power generated from LEDs may be provided to separate charge units. For example, electric power generated by blue color LEDs 302-1 to 302-L may be supplied to a charge unit 308 via control units 304-1 to 304-L, electric power generated by green color LEDs 312-1 to 312-M may be supplied to a charging unit 318 via control units 314-1 to 314-M, and electric power generated by red color LEDs 322-1 to 322-N may be supplied to a charging unit 328 via control units 324-1 to 324-N.

Figure 4:
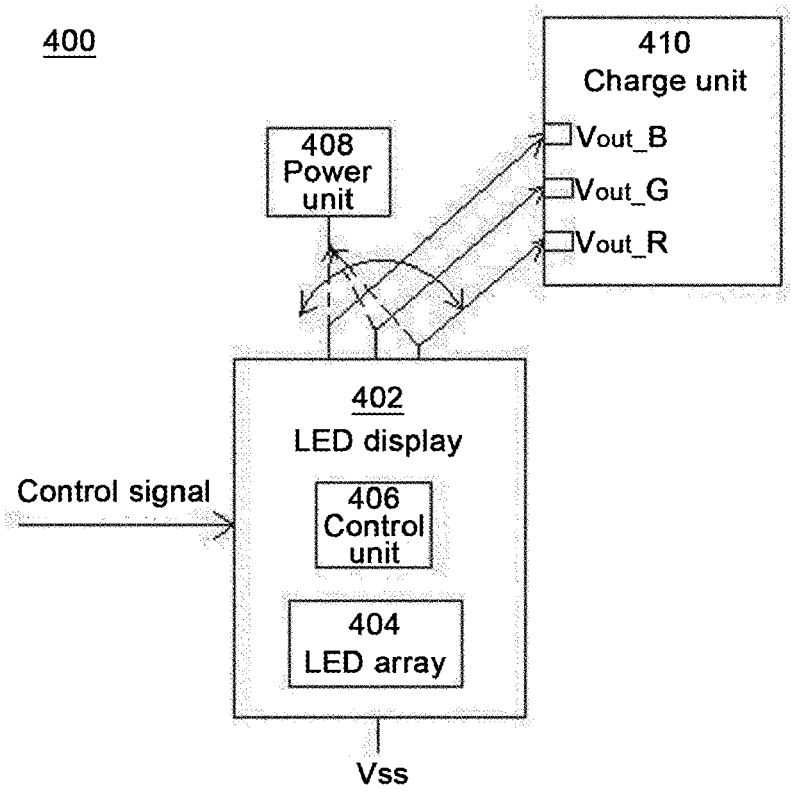
FIG. 4 shows a block diagram of an LED display according to an embodiment of the present disclosure.

FIG. 4, according to an embodiment of the present disclosure, shows a block diagram of an LED display configured to place three different color LEDs in either a display mode or a charge mode.

An LED display 402 may include an LED array 404 including a plurality of LEDs, and a control unit 406. Based on a control signal, the control unit 406 may connect the LEDs of the LED array 404 to a power unit 408 so that the LEDs of the LED array 404 are in a display mode, or the control unit 406 may connect the LEDs to a charge unit 410 so that the LEDs of the LED array 404 are in a charge mode. In the case of the charge mode, as described in FIGS. 3A to 3C, power output portions for LEDs having the same color may be connected and LEDs having the different colors may be electrically disconnected. In this case, electric power generated by LEDs may be supplied to separate charge units or to the separate terminals Vout_B, Vout_G, and Vout_R of the same charge unit.

Referring to FIGS. 3A to 4, embodiments including three different color LEDs are described above, but the present invention is not limited thereto. The present invention is similarly applicable to two colors of LEDs or four or more colors of LEDs.

Figure 5:
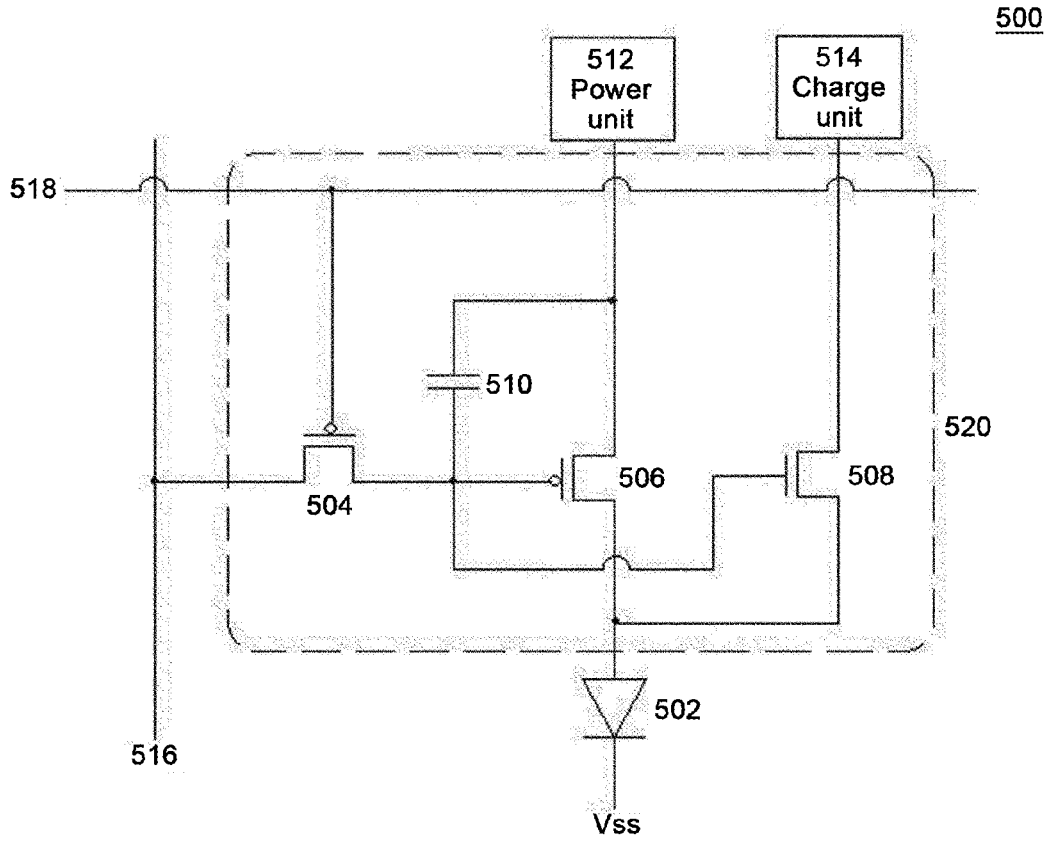
FIG. 5 shows an LED circuit according to an embodiment of the present disclosure.

FIG. 5 shows an LED circuit according to an embodiment of the present disclosure. An LED circuit 500 may include an LED 502, a control unit 520, a power unit 512 and a charge unit 514. The control unit 520 may include three transistors 504, 506 and 508 and a capacitor 510. A signal applied to a gate line 518 of the transistor 504 may determine an on/off state of the transistor 504 and a voltage applied to the capacitor 510 may be determined by a signal applied to a source line 516 of the transistor 504. An on/off state of the transistor 506 may be determined by the voltage applied to the capacitor 510, so that an on/off state of the LED 502 may be determined. For example, in a display mode, when a first voltage is applied to both ends of the capacitor 510, the transistor 506 is turned on and the LED 502 emits light while the transistor 508 is turned off. In a charge mode, when a second voltage, which is different from the first voltage, is applied to both ends of the capacitor 510, the transistor 508 is turned on while the transistor 506 is turned off. At this time, when light is incident on the LED 502, an electron-hole pair is generated in the LED 502 and the electron-hole pair is supplied to the charge unit 514 via the transistor 508.

FIG. 5 shows that a gate of the transistor 508 is connected to one end of the capacitor 510 and a gate of the transistor 506 so that the transistors 506 and 508 are turned on/off in a mutually exclusive manner. However, according to another embodiment, the gate of the transistor 508 may be connected to a separate control line (not shown) for controlling the on/off state of the transistor 508. For example, by including the separate control line, it is possible to provide power generated from the LEDs to a charge unit without driving elements such as the transistor 506 and the capacitor 510 in a charge mode, even when an LED display is off.

In FIG. 5, the transistors 504 and 506 are PMOS transistors, and the transistor 508 is an NMOS transistor. However, the present invention is not limited thereto, and any configuration or element may be applied to place the LED 502 in either a display mode or a charge mode.

In addition, while an LED display including the LED circuit of FIG. 5 is off (that is, a display function is not performed), the LED display may be utilized as a photovoltaic cell. The LED display may be used as a photovoltaic cell as well while the LED display is on (that is, a display function is performed). For example, in the case that the brightness of an LED is adjusted by a pulse width modulation (PWM) method, each R, B and G LEDs constituting each pixel may be on only for some time during display unless the entire screen is the brightest white. Therefore, even while displaying an image, some LEDs may be off for some time, and LEDs that are off may be utilized for a charge mode. In FIG. 5, this can be achieved by controlling transistor 506 and transistor 508 to be turned on/off mutually exclusively, depending on the time that LED 502 is in the display mode and the time that it is off. In this case, as described in FIGS. 3A to 4, power generated from LEDs may be provided to the charge unit 514 in a way in which LEDs of the same color among the R, G, and B colors are connected to each other and LEDs of different colors are electrically separated.

According to an embodiment, an LED in an off state in an LED display can be utilized for charging even when the LED display in a portable device such as a smart clock is on, thereby increasing the battery use time remarkably. In particular, since both a photovoltaic cell and a display screen are comprised of the same element, an LED display of the present embodiment does not require a separate area for a photovoltaic cell and there is no additional burden on the size and design of a portable device. In addition, since an LED serves as a photovoltaic cell as well as a light emitting device, the additional cost for the photovoltaic cell is not required.

The LED 502 in FIG. 5 is voltage-driven. However, an LED may be current-driven in a similar way.

Figure 6:
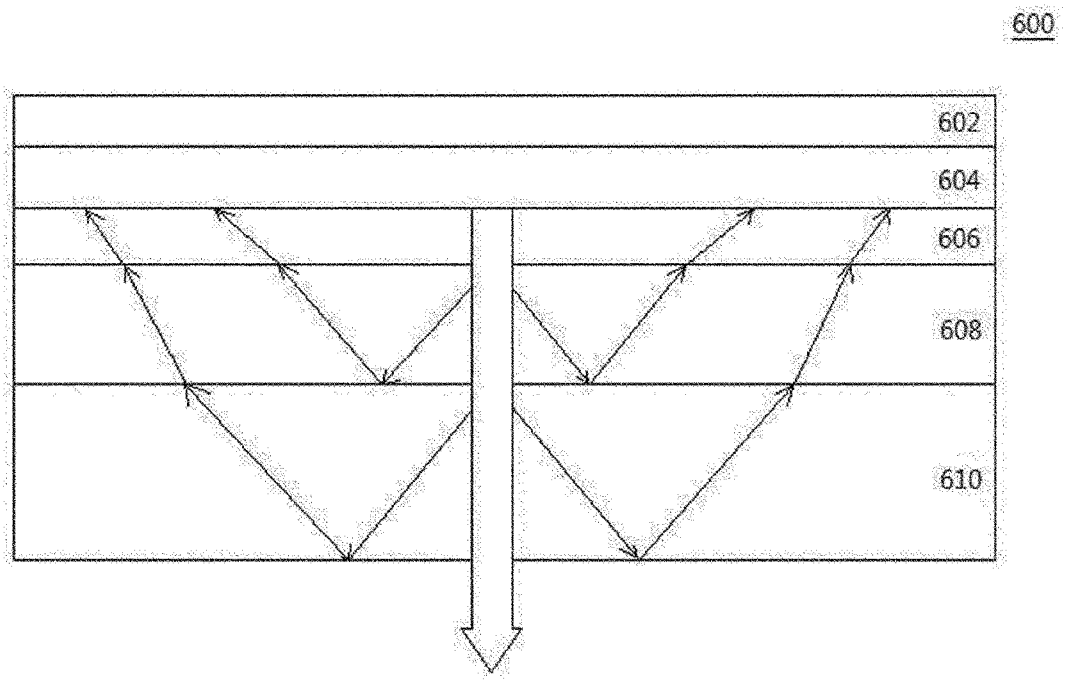
FIG. 6 shows a laminated structure of an LED display according to an embodiment of the present disclosure.

FIG. 6 shows a laminated structure of an LED display according to an embodiment of the present disclosure. For example, according to an embodiment, an LED display 600 may include a cathode 602, an electron injection electrode 604, an organic light emitting layer 606, a transparent electrode ITO 608, and a transparent substrate 610. As described in FIG. 6, due to a refractive index difference of the organic light emitting layer 606, the transparent electrode ITO 608 and the transparent substrate 610, a part of the light emitted from the organic light emitting layer 606 may be totally reflected from the transparent electrode ITO 608 or the transparent substrate 610, and then it may be incident on other portions of the organic light emitting layer 606. That is, additional electric power may be produced by utilizing light that is not used for display but is incident on the organic light emitting layer 606. For example, a refractive index of the transparent substrate 610 may be smaller than a refractive index of the transparent electrode ITO 608, and a refractive index of the transparent electrode ITO 608 may be larger than the refractive index of the organic light emitting layer 606.

In particular, when each pixel of the LED display is driven by a pulse width modulation (PWM) method, it is preferable that each pulse of a pulse sequence of adjacent pixels in the time domain does not overlap with each other within a predetermined period or that an overlap is minimized. Thus, when one pixel of the LED display is on, adjacent pixels may be turned off for as long as possible, so that the charging efficiency can be remarkably improved by utilizing incident light reflected from adjacent pixels for charging. For example, if a refractive index of a layer such as the transparent electrode ITO 608 and the transparent substrate 610 is determined, a position of an adjacent LED pixel on which the light totally reflected from the layer is incident may be calculated. Thus, by shifting a start point of pulses of each pulse sequence in the time domain that drives LED pixels separated by a distance determined based on the position calculated, the pulses may not overlap each other or an overlap may be minimized.

Figure 7A:
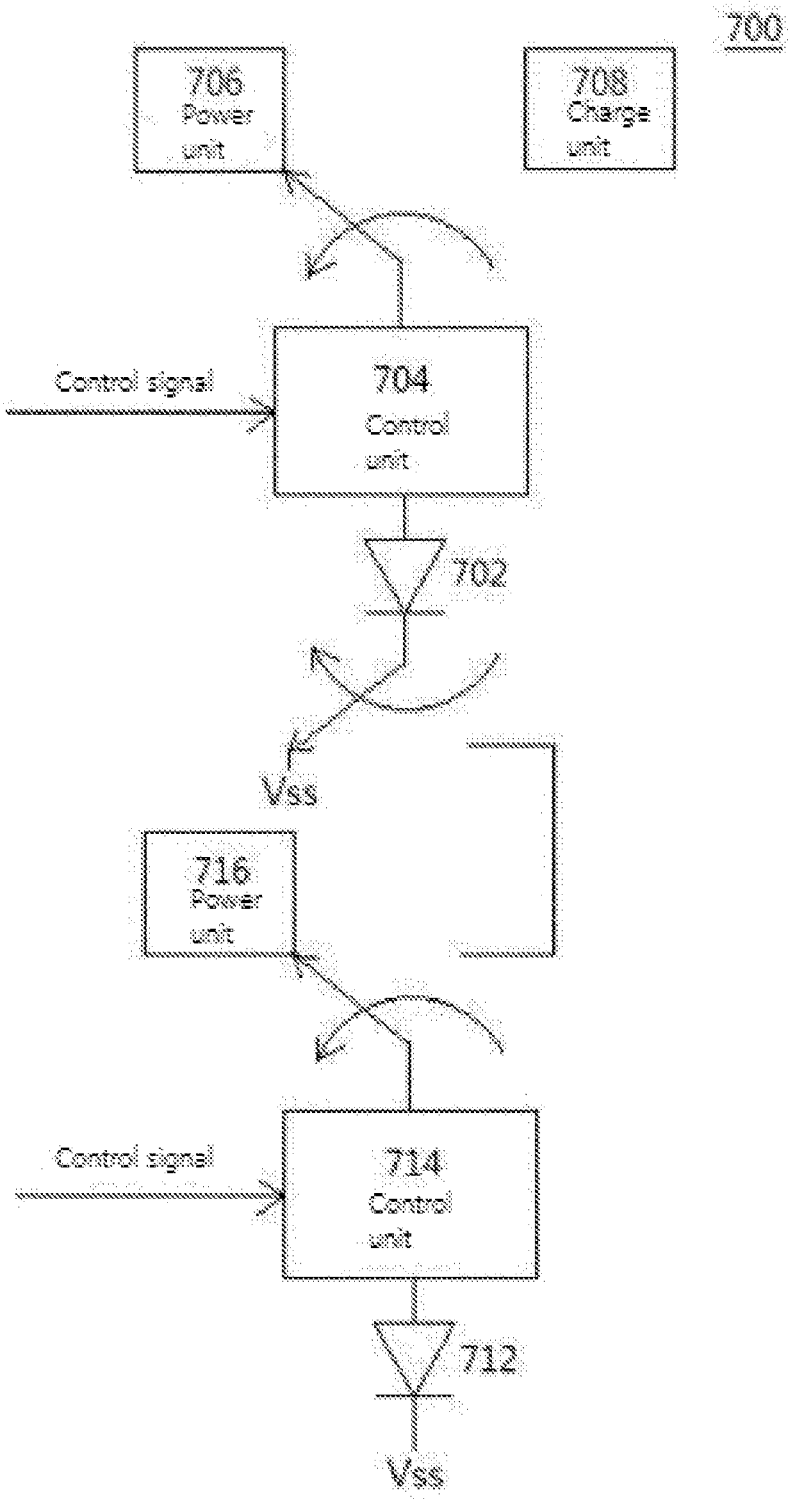
FIG. 7A shows a block diagram of an LED circuit in a display mode according to an embodiment of the present disclosure.
Figure 7B:
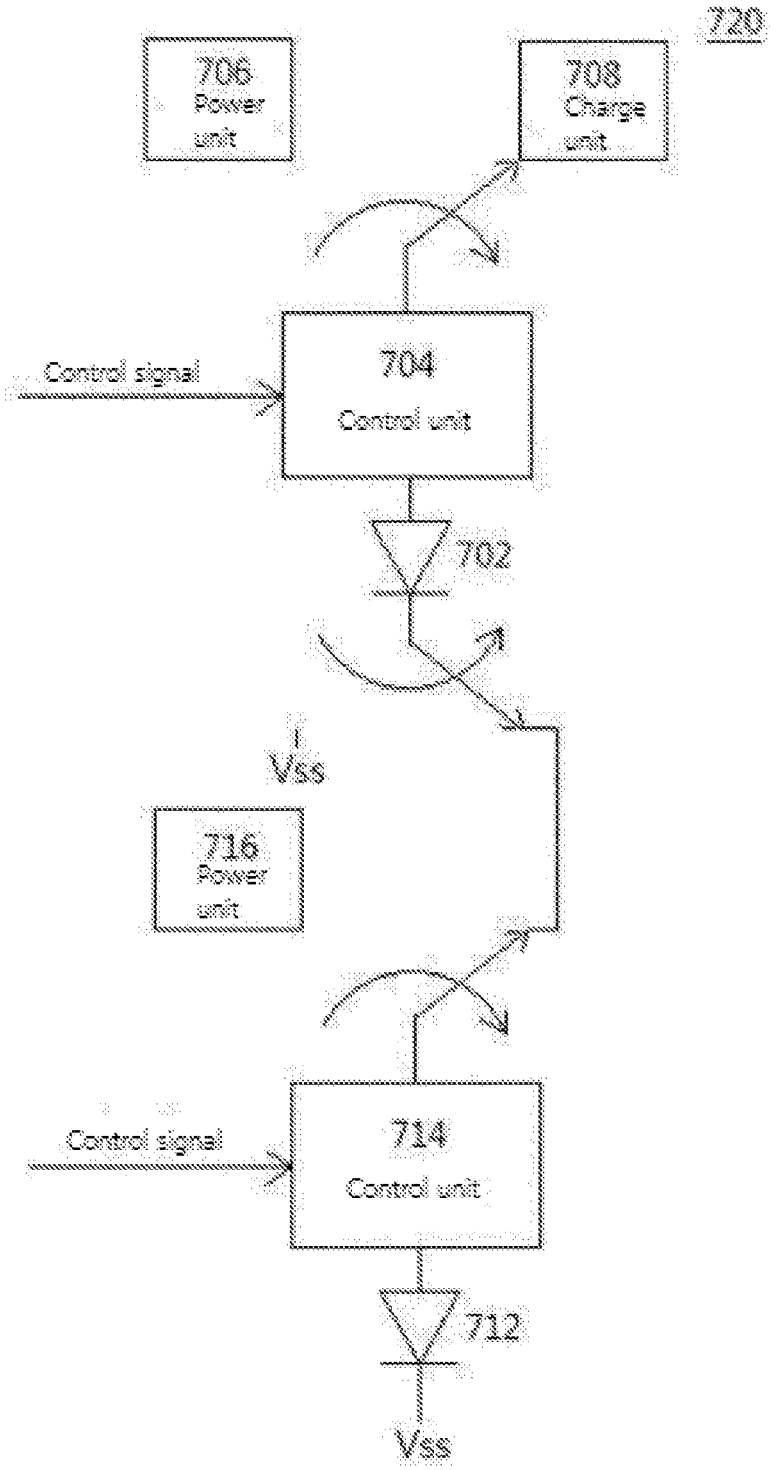
FIG. 7B shows a block diagram in which LED circuits in a charge mode are connected in series according to one embodiment of the present disclosure.

FIGS. 7A and 7B show a configuration for serially connecting two or more LED circuits in a charge mode to increase an output voltage according to an embodiment of the present disclosure.

Specifically, FIG. 7A shows that two LED circuits operate separately in a display mode, and FIG. 7B shows that two LED circuits in a charge mode are connected in series.

As shown in FIG. 7A, when two LED circuits are respectively in a display mode, an LED 702 may be connected to a power unit 706 via a control unit 704 based on a control signal, and an LED 712 may be connected to a power unit 716 via a control unit 714 based on a control signal.

As shown in FIG. 7B, when the two LED circuits are in a charge mode, the LED 712 may be connected to the LED 702 via the control unit 714 based on a control signal, and the LED 702 may be connected to a charge unit 708 via the control unit 704. Thus, it is possible to provide greater electric power to the charge unit 708 thanks to a series connection of the LEDs 702 and 712 in the charge mode.

The foregoing has described features of several embodiments in order to enable those of ordinary skill in the art to better understand aspects of the present disclosure. Those skilled in the art will readily appreciate that other processes and structures can be readily designed or modified using the teachings of the present disclosure to achieve the same objects and/or the same advantages as those disclosed herein. It will be understood by those skilled in the art that various changes, substitutions and alterations can be made herein without departing from the spirit and scope thereof, and without departing from the spirit and scope of the disclosure.

What is claimed is:

1. A light emitting device (LED) circuit capable of photovoltaic power generation, comprising:

a power unit;

a charge unit;

an LED capable of operating in either a display mode for emitting light when electric power is supplied from the power unit or a charge mode for producing electric power to supply the electric power produced by the LED to the charge unit when light is received, the LED configured to be connected to the power unit or the charge unit; and a control unit for controlling a connection between the LED and the power unit and a connection between the LED and the charge unit, the control unit comprising a control signal receiving unit receiving a control signal and a switching unit operating based on the control signal, wherein the control unit is connected to either the power unit or the charge unit according to the control signal, whereby the LED is indirectly connected, through the control unit, to either the power unit or the charge unit, wherein, when the control signal receiving unit receives a first control signal for operating the LED in the display mode, the control unit controls the switching unit to connect the LED to the power unit to supply the electric power to the LED so that the LED emits the light; and when the control signal receiving unit receives a second control signal for operating the LED in the charge mode, the control unit controls the switching unit to connect the LED to the charge unit to supply the electric power produced by the LED to the charge unit.

2. The LED circuit of claim 1, wherein the LED is an active-matrix organic light-emitting diode (AMOLED).

3. A light emitting device (LED) display capable of photovoltaic power generation, comprising:

an array of a plurality of LEDs, wherein each of the LEDs operates in either a display mode for emitting light when electric power is supplied or a charge mode for producing electric power when light is received, and each of the LEDs is configured to be connected to a power unit that supplies the electric power or a charge unit that is supplied with the electric power produced; and a control unit for controlling a connection between each of the plurality of LEDs and the power unit and a connection between each of the plurality of LEDs and the charge unit, wherein the control unit includes a control signal receiving unit receiving a control signal and a switching unit operating based on the control signal, wherein, when the control signal receiving unit receives a first control signal for operating in the display mode in which one or more first LED among the plurality of LEDs emits light, the control unit controls the switching unit to connect the one or more first LED to the power unit to supply the power to the one or more first LED so that the one or more first LED emits light, and wherein, when the control signal receiving unit receives a second control signal for operating in the charge mode in which one or more second LED among the plurality of LEDs produces electric power, the control unit controls the switching unit to connect the one or more second LED to the charge unit to supply the electric power produced by the one or more second LED to the charge unit.

4. The LED display of claim 3, wherein each of the plurality of LEDs is an Active-Matrix Organic Light-Emitting Diode (AMOLED).

5. The LED display of claim 3, wherein at least one of the one or more second LED produces electric power while at least one of the one or more first LED emits light.

6. The LED display of claim 5, wherein at least one of the one or more second LED produces the electric power from at least one of i) light from outside the LED display and ii) a portion of light emitted from at least one of the one or more first LED.

7. The LED display of claim 3, wherein at least one of a transparent electrode or a transparent substrate is laminated on a light emitting surface of the plurality of LEDs.

8. The LED display of claim 7, wherein a first pulse of the first control signal causes a first LED among the plurality of LEDs to emit light in a display mode, a second pulse of a third control signal causes a third LED among the plurality of LEDs to emit light in a display mode, and at least one of the first pulse and the second pulse is shifted in time within one period of each control signal so that overlap in the time domain between the first pulse and the second pulse is minimized, and wherein a part of the light emitted from the first LED is totally reflected from the transparent electrode or the transparent substrate, and is incident on the second LED.

9. The LED display of claim 3, wherein, when the plurality of LEDs of the array are configured to include a plurality of colors, electric power generated by at least two or more LEDs of the same color among two or more of the second LEDs is combined and are provided to the charge unit independently of electric power generated by the LEDs of different colors.

10. The LED display of claim 3, wherein two or more second LEDs produce electric power and the control unit is configured to connect at least two second LEDs among the two or more second LEDs in series to provide increased electric power to the charge unit.

11. The LED display of claim 3, wherein, when the power unit is turned off, the control unit is configured to connect the array of the plurality of LEDs to the charge unit via the switching unit.

12. A method for operating a light emitting device (LED) display capable of photovoltaic power generation, the method comprising:

receiving either a first control signal causing each of a plurality of LEDs included in the LED display to operate in a display mode to emit light or a second control signal causing each of the plurality of LEDs to operate in a charge mode to produce electric power, wherein each of the plurality of LEDs operates either in the display mode or in the charge mode;

connecting, when the first control signal to operate one or more first LED among the plurality of LEDs in the display mode for emitting light is received, the one or more first LED to a power unit to emit light; and supplying, when the second control signal to operate one or more second LED among the plurality of LEDs in the charge mode for producing electric power is received, electric power generated by the one or more second LED to a charge unit by connecting the one or more second LED to the charge unit.

13. The method of claim 12, wherein each of the plurality of LEDs is an Active-Matrix Organic Light-Emitting Diode (AMOLED).

14. The method of claim 12, at least one of the one or more second LED produces electric power while at least one of the one or more first LED emits light.

15. The method of claim 14, wherein the at least one of the one or more second LED produces the electric power from at least one of i) light from outside the LED display and ii) a portion of light emitted from at least one of the one or more first LED.

16. The method of claim 12, wherein at least one of a transparent electrode or a transparent substrate is laminated on a light emitting surface of the plurality of LEDs.

17. The method of claim 16, wherein a first pulse of the first control signal causes a first LED among the plurality of LEDs to emit light in a display mode, a second pulse of a third control signal causes a third LED among the plurality of LEDs to emit light in a display mode, and at least one of the first pulse and the second pulse is shifted in time within one period of each control signal so that overlap in the time domain between the first pulse and the second pulse is minimized, and wherein a part of the light emitted from the first LED is totally reflected from the transparent electrode or the transparent substrate, and is incident on the second LED.

18. The method of claim 12, wherein, when the plurality of LEDs of an array of the LEDs are configured to include a plurality of colors, electric power generated by at least two or more LEDs of the same color among two or more of the second LEDs is combined and are provided to the charge unit independently of electric power generated by the LEDs of different colors.

19. The method of claim 12, wherein two or more second LEDs produce electric power; and wherein the method further comprises: connecting at least two second LEDs among the two or more second LEDs in series to provide increased electric power to the charge unit.

* * * * *